United States Patent [19]

Hasegawa

[11] Patent Number: 4,467,761

[45] Date of Patent: Aug. 28, 1984

[54] ENGINE RPM CONTROL METHOD FOR INTERNAL COMBUSTION ENGINES

[75] Inventor: Shumpei Hasegawa, Niiza, Japan

[73] Assignee: Honda Motor Co., Ltd., Tokyo, Japan

[21] Appl. No.: 484,624

[22] Filed: Apr. 13, 1983

[30] Foreign Application Priority Data

Apr. 21, 1982 [JP] Japan ..... 57-66928

[51] Int. Cl.[3] ..... F02D 11/10

[52] U.S. Cl. ..... 123/339

[58] Field of Search ..... 123/339, 585

[56] References Cited

U.S. PATENT DOCUMENTS

| | | | |
|---|---|---|---|
| 2,929,226 | 3/1960 | Baker et al. | 123/339 |
| 3,964,457 | 6/1976 | Coscia | 123/339 |
| 4,186,697 | 2/1980 | Yasuda | 123/339 |
| 4,191,051 | 3/1980 | Kawata | 123/339 |

FOREIGN PATENT DOCUMENTS

| | | | |
|---|---|---|---|
| 56-96126 | 4/1981 | Japan | 123/339 |
| 2085619 | 4/1982 | United Kingdom | 123/339 |

*Primarv Examiner*—Ronald B. Cox

*Attorney, Agent, or Firm*—Arthur L. Lessler

[57] ABSTRACT

An engine rpm control method for controlling the quantity of supplementary air being supplied to an internal combustion engine equipped with a plurality of electrical devices, in a manner responsive to the operating conditions of the engine. During the rpm control of the engine, simultaneously with the application of an electrical load on the engine, the quantity of supplementary air is increased by a predetermined amount. Such a predetermined amount is provided for each of the electrical devices and previously set at a value corresponding to the magnitude of a corresponding one of the electrical devices. When two or more electrical loads are applied on the engine at the same time, the amount of increase in the supplementary air quantity is determined by the sum of as many predetermined amounts corresponding to the respective electrical loads applied. The aforesaid operating conditions of the engine include idling rpm feedback control mode operation, deceleration with the throttle valve fully closed wherein the engine rpm drops toward the feedback controlling rpm region, and acceleration with the throttle valve opened wherein the engine rpm increases from the feedback controlling rpm region.

8 Claims, 8 Drawing Figures

ENGINE RPM CONTROL METHOD FOR INTERNAL COMBUSTION ENGINES

BACKGROUND OF THE INVENTION

This invention relates to a method of controlling the engine rpm of an internal combustion engine, and more particularly to a method of this kind which is capable of improving the accuracy of control of the engine rpm, by minimizing fluctuations in the engine rpm due to changes in the electrical loads applied on the engine during rpm control of the engine.

An idling rpm feedback control method is known e.g. from Japanese Patent Provisional Publication No. 55-98628, wherein, after setting the desired idling rpm in response to the engine load at the time of engine idle, supplementary air is supplied to the engine in an amount depending on the difference between the desired idling rpm and the actual engine rpm, so as to make this difference zero to thereby bring the engine rpm to the desired idling rpm. During idling rpm feedback control (hereinafter called "feedback mode control"), according to the above known method, if electrical devices such as head lamps, an air conditioner, etc. are operated, such operations result in increasing the engine load. Further, in order to recharge the battery to supply power to these electrical devices when the battery output voltage drops below a certain level, the generator has to function, resulting in increased engine load and a consequent drop in the engine rpm. Even in the case of such a drop in the engine rpm, the engine rpm recovers a value close to the desired idling rpm by the feedback mode control. But, in case such electrical load applied on the engine is very large, it can result in engine stall, or if the vehicle is started simultaneously with the addition of such electrical load, the clutch can not be operated smoothly.

It is also a well known control method to control the rpm of the engine by gradually increasing the quantity of supplementary air being supplied to the engine with a decrease in the engine rpm from the time the engine rpm reaches a level below a predetermined rpm to the time it reaches the upper limit of the desired idling rpm range, while the engine is decelerating with its throttle valve fully closed, in order to prevent engine stall caused by a sudden drop in the engine rpm due to disengagement of the clutch (e.g. Japanese Patent Provision Publication No. 55-98629). Even in the case of such control of the supply of supplementary air to the engine during deceleration (hereinafter called "deceleration mode control"), if electrical load is added particularly when the clutch is in a state of disengagement, the engine speed can abruptly drop, resulting in engine stall, as the quantity of supplementary air then supplied becomes insufficient.

Further, in the event the engine is accelerated with the throttle valve opened, during feedback mode control of the idling engine, if the supply of supplementary air to the engine is interrupted simultaneously with the opening of the throttle valve the total intake air quantity being supplied to the engine abruptly drops, causing a drop in the engine rpm and making it difficult to engage the clutch without causing engine stall.

In order to eliminate this difficulty, it has been proposed by the applicant of the present application that the quantity of supplementary air to be supplied immediately after the opening of the throttle valve is set to the quantity of supplementary air determined during feedback control mode immediately before the opening of the throttle valve, and this quantity of supplementary air is then gradually decreased in proportion to the increase in the engine rpm. During this gradual decrease of the supply of supplementary air (hereinafter called "acceleration mode control"), if electrical load is added to the engine load, the engine speed abruptly drops, causing discomfort to the driver, because at this stage, the engine rpm is not yet large enough and the engine output is also not sufficient.

SUMMARY OF THE INVENTION

It is the object of the invention to provide an engine rpm control method which can effectively prevent a drop in the engine rpm by promptly supplying an increased quantity of supplementary air to the engine when at least one electrical load is added to the engine load while the engine rpm is being controlled through control of the supplementary air quantity, thereby preventing engine stall and avoiding any discomfort to the driver.

According to this invention, a method is provided for controlling the engine rpm of an internal combustion engine having an intake passage, a throttle valve arranged in the intake passage and an air passage, one end of which communicates with the intake passage at a location downstream of the throttle valve arranged therein and the other end of which communicates which the atmosphere, respectively, and through which supplementary air is supplied to the engine. The quantity of such supplementary air is controlled in response to the operating conditions of the engine.

The method according to this invention is characterized by the following steps:

(a) setting a plurality of different predetermined quantities of supplementary air to be supplied to the engine, which individually correspond to the magnitudes of electrical loads applied by respective ones of the aforementioned electrical devices.

(b) detecting the on-off state of each of the electric devices; and (c) simultaneously with detection of the on-state of each of the electrical devices, increasing the quantity of supplementary air by one of the above different predetermined quantities that corresponds to the magnitude of the electrical load applied by the above each electrical device that is in on-state.

Preferably, when two or more of the electrical devices are in on-state at the same time, the above predetermined quantity by which the supplementary air quantity is to be increased is the sum of the above predetermined quantities dependent upon electrical loads produced by the electrical devices that are in on-state.

The above and other objects, features and advantages of the invention will be more apparent from the ensuing detailed description taken in conjunction with the accompanying drawings.

DETAILED DESCRIPTION

The method of the invention will now be described in detail with reference to the accompanying drawings.

Figure 1:
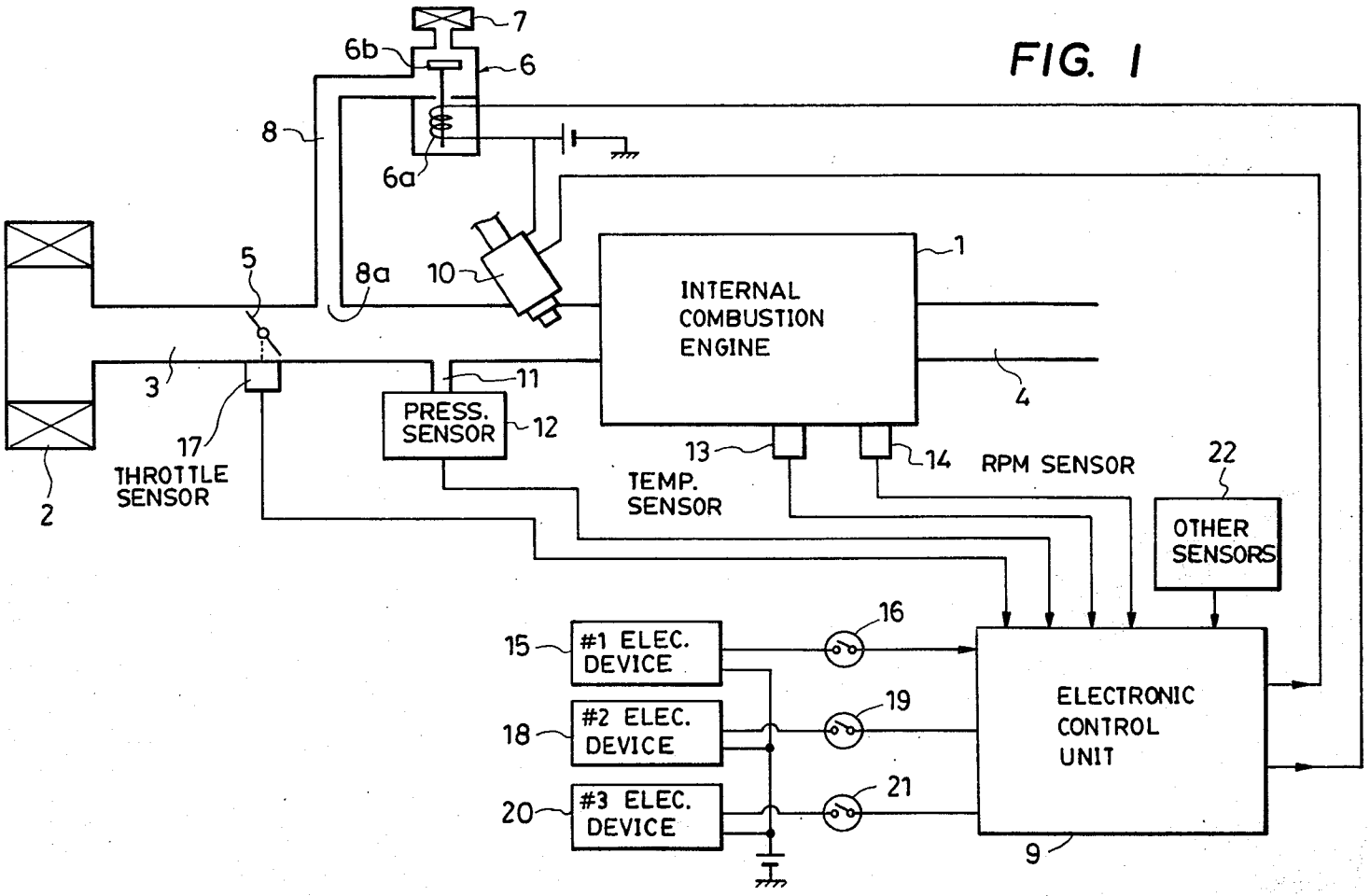
FIG. 1 is a block diagram illustrating the whole arrangement of an idling rpm feedback control system to which the method of the invention is applicable.

Referring first to FIG. 1, an idling rpm feedback control system is schematically illustrated, to which is applicable the method of the invention. In FIG. 1, reference numeral 1 designates an internal combustion engine which may be a four-cylinder type, and to which are connected an intake pipe 3 with an air cleaner 2 mounted at its open end and an exhaust pipe 4, at an intake side and an exhaust side of the engine 1, respectively. A throttle valve 5 is arranged within the intake pipe 3, and an air passage 8 opens at its one end 8*a* in the intake pipe 3 at a location downstream of the throttle valve 5. The air passage 8 has its other end communicating with the atmosphere and provided with an air cleaner 7. A supplementary air quantity control valve (hereinafter called merely "the control valve") 6 is arranged across the air passage 8 to control the quantity of supplementary air being supplied to the engine 1 through the air passage 8. This control valve 6 is a normally closed type and comprises a solenoid 6*a* and a valve 6*b* disposed to open the air passage 8 when the solenoid 6*a* is energized. The solenoid 6*a* is electrically connected to an electronic control unit (hereinafter called "ECU") 9. A fuel injection valve 10 is arranged in a manner projected into the intake pipe 3 at a location between the engine 1 and the open end 8*a* of the air passage 8, and is connected to a fuel pump, not shown, and also electrically connected to the ECU 9.

A throttle valve opening sensor 17 is mounted on the throttle valve 5, and an absolute pressure sensor 12 is provided in communication with the intake pipe 3 through a conduit 11 at a location downstream of the open end 8*a* of the air passage 8, while an engine cooling water temperature sensor 13 and an engine rpm sensor 14 are both mounted on the body of the engine 1. All the sensors and other sensors 22 for detecting other parameters of the operating condition on the engine 1 are electrically connected to the ECU 9.

Reference numerals 15, 18 and 20 represent first, second and third electrical devices, such as head lamps, an air conditioner, a brake lamp, and a radiater cooling fan, which are electrically connected to the ECU 9 through switches represented by reference numerals 16, 19 and 21, respectively.

The idling rpm feedback control system constructed as above operates as follows: Engine operation parameter signals generated by the throttle valve opening sensor 17, the absolute pressure sensor 12, the engine cooling water temperature sensor 13, the engine rpm sensor 14 and the other engine parameter sensors 22 are supplied to the ECU 9. Then, the ECU 9 determines the operating conditions of the engine 1 and the electrical loads on the same on the basis of the read values of these engine operation parameters, and the signals indicative of electrical loads produced by the first, second and third electrical devices 15, 18 and 20 and supplied to the ECU 9 and then calculates a desired quantity of fuel to be supplied to the engine 1, that is, a desired valve opening period of the fuel injection valve 10, and also a desired quantity of supplementary air to be supplied to the engine, that is, a desired valve opening period of the control valve 6, on the basis of the determined operating conditions of the engine and the electrical loads on the same. Then the ECU supplies driving pulses corresponding to the calculated values to the fuel injection valve 10 and the control valve 6. The valve opening period of control valve 6 is determined by the ratio of the on-state period to the pulse separation of a signal synchronous with the rotation of the engine 1, e.g. a pulse signal having each pulse generated at predetermined crank angle of the engine 1, or a pulse signal having its pulses generated at constant time intervals.

The control valve 6 has its solenoid 6*a* energized by each of its driving pulses to open the air passage for a period of time corresponding to its calculated valve opening period value so that a quantity of supplementary air corresponding to the calculated valve opening period value is supplied to the engine through the air passage 8 and the intake pipe 3.

The fuel injection valve 10 is energized by each of its driving pulses to open for a period of time corresponding to its calculated valve opening period value to inject fuel into the intake pipe 3. The ECU 5 operates so as to supply an air-fuel mixture having a predetermined air-fuel ratio to the engine 1.

When the valve opening period of the control valve 6 is increased to increase the quantity of supplementary air, an increased quantity of the mixture is supplied to the engine 1 to increase the engine output, resulting in an increase in the engine rpm, whereas a decrease in the valve opening period causes a corresponding decrease in the quantity of the mixture, resulting in a decrease in the engine rpm. In this manner, the engine speed is controlled by the control of the quantity of supplementary air or the valve opening period of the control valve 6.

Details of the control of supplementary air quantity dependent upon electrical load performed by the idling rpm feedback control system constructed above will now be described in detail with reference to FIG. 1 already referred to and FIG. 2 through FIG. 6.

Figure 2:
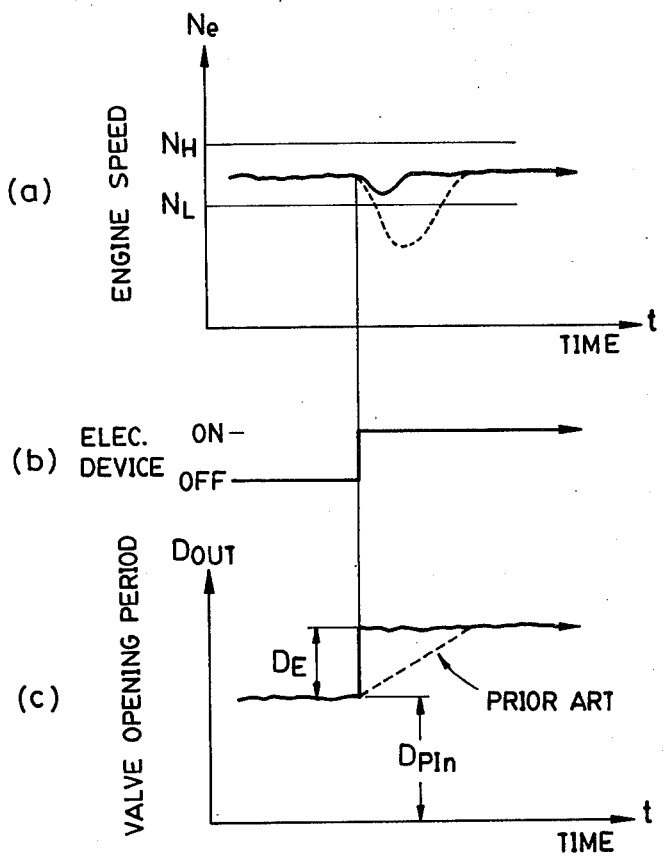
FIG. 2 is a timing chart showing the control manner of the invention which is carried out when electrical load is applied to the engine during idling rpm feedback control.

FIG. 2 shows a control process of the increase in the supply of supplementary air to the engine, carried out when an electrical load is applied on the engine during idling rpm feedback control. As shown in (a) in the same figure, control is effected in feedback mode to maintain the engine rpm Ne between the upper and lower limits NH and NL of the desired idling rpm range. In such feedback mode control, the difference between the actual engine rpm Ne as determined by the engine rpm sensor 14 and the desired idling rpm of the engine which is set in response to the engine load, as determined by the ECU 9, is calculated and the opening period of the control valve 6 is controlled in response to this difference so as to make it zero.

Now, as shown in FIG. 1, while the engine is in feedback mode control, when at least one of the switches 16, 19 and 21 of the first second and third electrical devices 15, 18 and 20 turns on, thereby producing an electrical load on the engine, if no countermeasure is taken, and the engine rpm Ne largely drops, as shown by the broken line in (a) in FIG. 2, the drop being in proportion to the increase in the electrical load. In response to the extent of the drop in the engine rpm Ne, feedback mode control is applied; that is, the quantity of supplementary air being supplied to the engine is increased (the broken line in (c) in FIG. 2) to promptly return the engine rpm Ne within the upper and lower limits NH and NL of the desired idling rpm range. However, if this drop in the engine rpm Ne generated by the electrical load is very large, it can possibly result in engine stall and also if the vehicle is started simultaneously when the electrical load is applied on the engine, it can become difficult to engage the clutch smoothly without causing engine stall, badly affecting the driveability of the engine.

When electrical load is added to the engine load on occasions as mentioned above, the amount of increase in the control valve opening period (hereinafter called "electrical load term", shown as DE in (c) in FIG. 2) required to supply an increased quantity of supplementary air necessary ((c) in FIG. 2) to maintain the engine rpm Ne at the desired idling rpm, can be estimated by the type of electrical device that produces the electrical load. According to this invention, therefore, on-state signals of the electrical devices indicative of additional electrical load are determined, and simultaneously with the output of such an on-state signal, the electrical load term DE of the corresponding electrical device, which is determined in advance for each of the electrical devices, is added to the present basic valve opening period DPIn to calculate the control valve opening period DOUT ((c) in FIG. 2). In this way, the valve opening period DOUT is determined by the following equation:

$$DOUT = DPIn + DE \quad (1)$$

where DPIn is a basic valve opening period which varies with a change in the difference between actual engine rpm and the desired idling rpm.

It is thus possible to quickly return the engine rpm to the desired idling rpm, by supplying an increased amount of supplementary air to the engine simultaneously as the electrical load is applied on the engine and the delay in feedback mode control can greatly be reduced (solid lines in (a) and (c) in FIG. 2).

Figure 3:
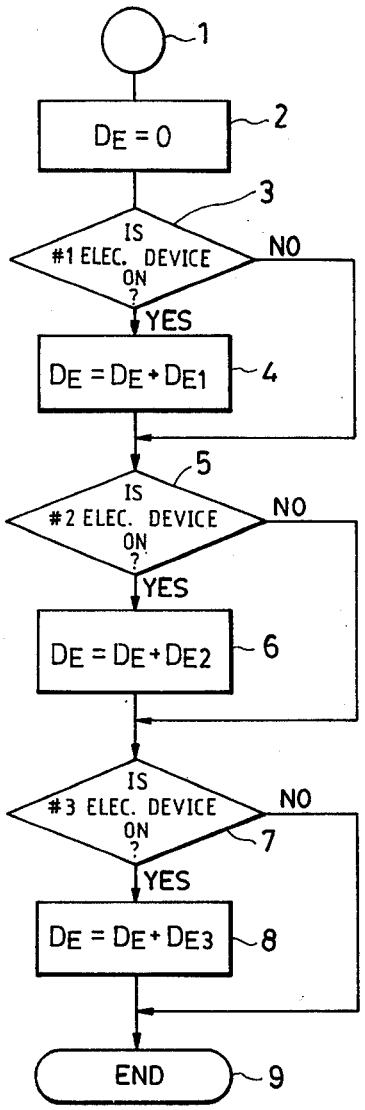
FIG. 3 is a flow chart showing a routine for calculating the value of the electrical load term DE of the control valve opening period DOUT, which is executed inside the Electrical Control Unit (ECU) in FIG. 1.

FIG. 3 shows a flow chart of a routine for execution of the calculation of the electrical load term DE within the ECU 9.

When this program is called at the step 1 in FIG. 3, the stored value of DE is reset to zero at the step 2. Next, at the step 3, it is determined whether or not the switch 16 of the first electrical device 15, shown in FIG. 1, is in on-state. If the answer to this question is no, the program proceeds to the step 5. If, at the step 3, the answer is yes, a predetermined electrical load term DEI corresponding to the electrical load produced by the electric device 15 is added to the stored value of the electrical load term DE and the resulting sum value $DE+DE_1$ is set as a new stored value of electrical load term DE for the electrical device 15 in the step 4. Since, in this case, the stored value of DE is reset to zero ($DE=0$) at the step 2, the newly stored value of the electrical load term $DE+DE_1$ is equal to $DE_1$.

Then, in the aforesaid manner, the on-off state of the switch 19 of the second electrical device 18 is determined in the step 5. If it is not in on-state, the program proceeds to the step 7 and if it is in on-state, a predetermined electrical load term $DE_2$ relating to the electrical load produced by the second electrical device 18 is added to the stored value of electrical load term DE, and the resulting sum value $DE+DE_2$ is set as a new stored value of electrical load term DE for the electrical device 18, at the step 6. Further, in the aforesaid manner, the on-off state of the switch 21 of the third electric device 20 is determined at the step 7. If it is not in on-state, the program is terminated at the step 9, and if it is in on-state, a predetermined electrical load term $DE_3$ relating to the third electrical device 20 is added to the stored value of the electrical load term DE and the resulting sum value $DE+DE_3$ is set as a new stored value of electrical load term DE for the electrical device 20 in the step 8, and then the program is terminated.

In the manner explained hereabove, the electrical load term DE in the Equation (1) is determined by first determining the respective on-off states of the first, second and third electrical devices 15, 18 and 20 and for each electrical device that is in on-state, a predetermined electrical load term relating to the electrical load produced by the device is added to the stored value of the electrical load term DE, and this new value is set as the updated electrical load term DE.

Figure 4:
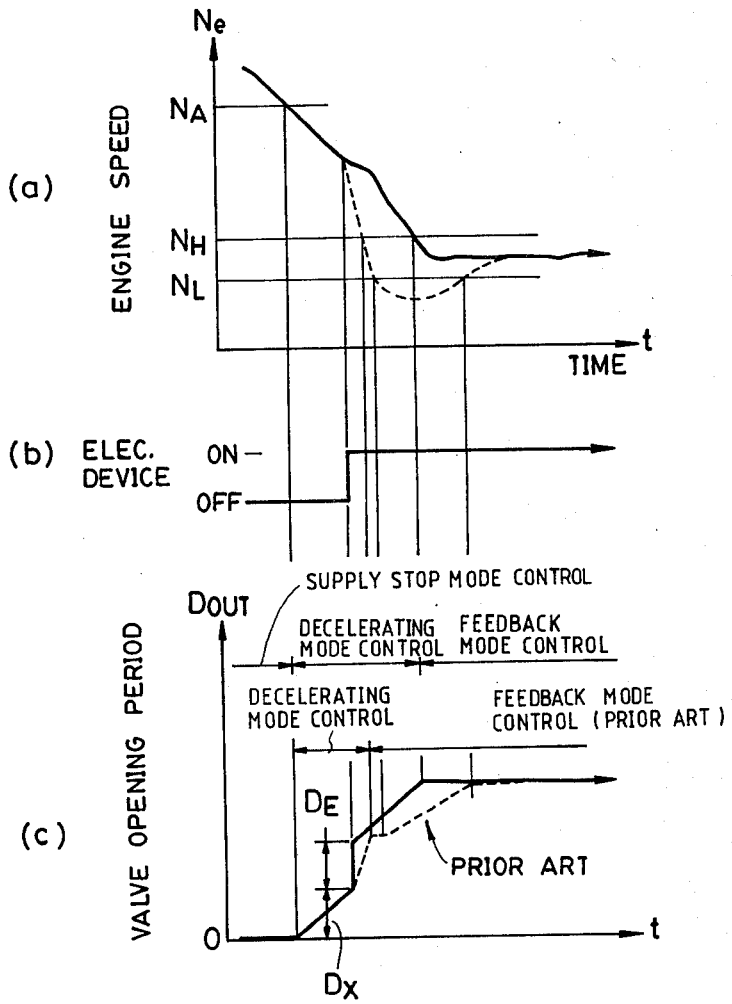
FIG. 4 is a timing chart showing the control manner of the invention which is carried out when electrical load is applied on the engine while the engine is decelerating with the throttle valve fully closed wherein the engine rpm drops toward the idling rpm feedback control region.

FIG. 4 shows a manner of control of the amount of increase in the quantity of supplementary air to be supplied to the engine, applied when electrical load is applied on the engine while the engine is decelerating with the throttle valve fully closed.

When the engine rpm decreases with the throttle valve 5 in FIG. 1 fully closed, and falls below predetermined rpm NA, the control valve 6 opens to start the supply of supplementary air to the engine as shown in (a) and (c) in FIG. 4. This supplementary air quantity is gradually increased as the engine rpm decreases from the predetermined rpm NA until it reaches the upper limit NH of the desired idling rpm range, and at the upper limit NH it is set to a quantity required to maintain the engine rpm within the desired idling rpm range at a time when no electrical load is applied on the engine (this control of supplementary air is hereinafter called "deceleration mode control").

As soon as the engine rpm Ne falls below the predetermined upper limit NH of the desired idling rpm range, the feedback mode control, explained in FIG. 2, takes over.

In the manner explained hereabove, while the engine is decelerating with the throttle valve 5 fully closed, a gradual increase in the supply quantity of supplementary air is effected with a decrease in the engine rpm once the engine rpm Ne becomes lower than the predetermined engine rpm NA which is higher than the predetermined upper limit NH of the desired idling rpm range. Therefore, even if the clutch is disengaged during the deceleration, a drastic drop in the engine rpm resulting in engine stall can be prevented.

When electrical load is added to the engine load while the engine is in the deceleration mode control, as shown in (b) in FIG. 4, the engine load increases in the same way as during feedback mode control as shown in FIG. 2. On such occasion, despite the supply of gradually increased quantity of supplementary air to the engine in deceleration mode control, the quantity of such increased amount of supplementary air can be insufficient causing the engine rpm to abruptly drop as shown by the broken line in (a) of FIG. 4 and depending on the magnitude of the electrical load, can result in engine stall, particularly when the clutch is already in a state of disengagement.

Even when the engine is in deceleration mode control, it is possible to estimate the necessary quantity of supplementary air to be supplied to the engine in proportion to the electrical load that corresponds to the kind of the electrical device, that is in on-state. Therefore, according to the invention, the signal indicative of the on-off state of the electrical devices is monitored, and simultaneously when the signal turns on, the valve opening period DOUT of the control valve 6 is increased by an amount corresponding to the electrical load term DE relating to the electrical device that is switched on, as shown in (c) in FIG. 4. That is, the control valve opening period DOUT is determined by the following equation:

$$DOUT = DX + DE \quad (2)$$

where DE is determined in the same manner as referred to in FIG. 3 and DX is a deceleration mode term.

Figure 5:
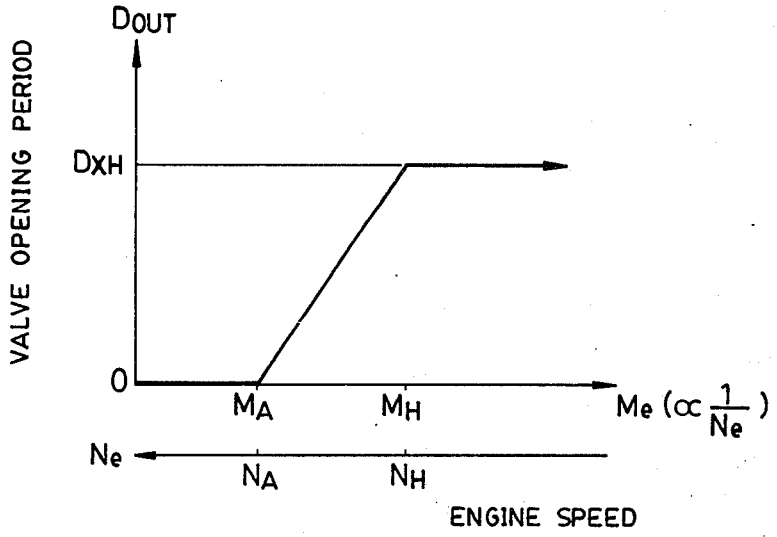
FIG. 5 is a graph showing the relationship between the engine rpm and the deceleration mode term value DX of the control valve opening period DOUT during deceleration mode.

FIG. 5 shows an example of the relationship between the deceleration mode term DX and the engine rpm Ne. When the engine rpm Ne is between the predetermined rpm NA and the upper limit NH of the desired idling rpm range, the control valve opening period DX corresponds to a value Me which is proportional to the reciprocal of actual engine rpm Ne. When the engine rpm Ne is higher than the predetermined value NA, that is $Ne \geqq NA$, the value DX is maintained at zero, and when the engine rpm Ne is below the upper limit NH, that is $Ne \leqq NH$, the value DX is set to a predetermined value DXH. Here, the predetermined value DXH is set at a value necessary to obtain a desired idling rpm at the time of engine idle with no load on the engine, including electrical load. The above value Me is used for the purpose of processing within the ECU and corresponds to the time interval between adjacent pulse signals generated in response to the engine rpm, as detected by the engine rpm sensor 14. That is, the larger the engine rpm Ne, the smaller the value of Me becomes.

In the aforesaid manner, by supplying an increased amount of supplementary air, as calculated by the use of the equation (2), to the engine at the same time as electrical load is added to the engine load, not only can an abrupt drop in the engine rpm be avoided but the driveability of the engine can also be improved.

Figure 6:
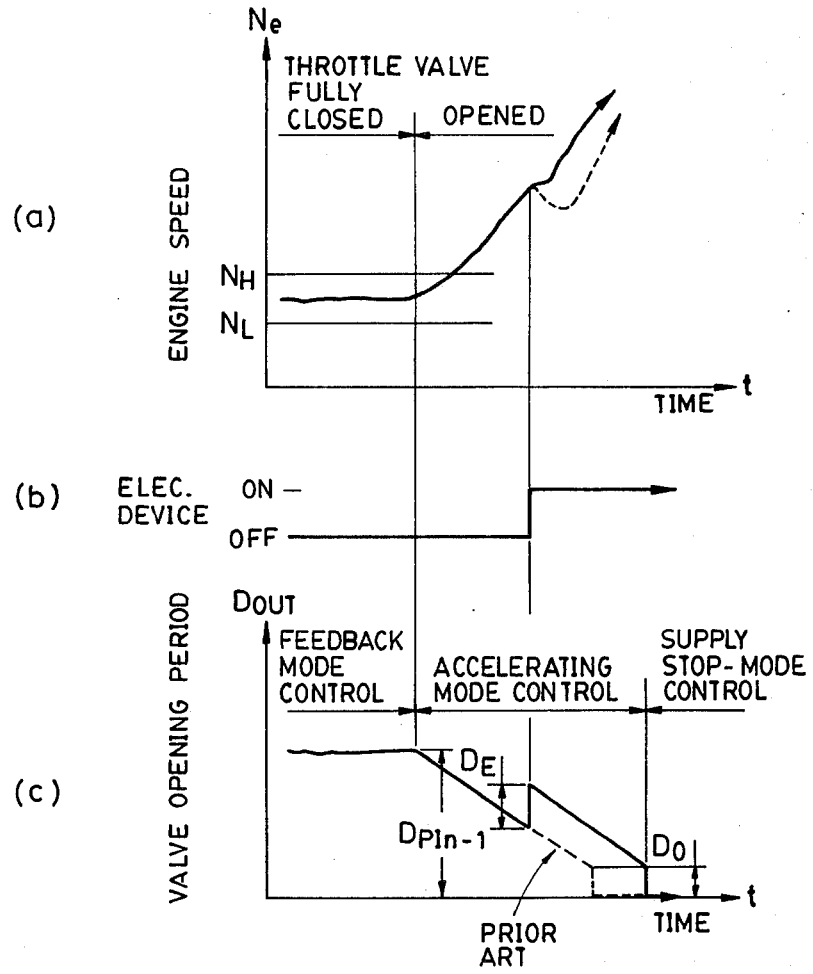
FIG. 6 is a timing chart showing the control manner of the invention, which is carried out when electrical load is applied on the engine while the engine is accelerating from the idling rpm feedback control region.

Next, FIG. 6 shows the method for controlling the increase in the quantity of supplementary air to be supplied to the engine, applicable in the event that electrical load is applied on the engine while the engine is accelerating with the throttle valve 5, shown in FIG. 1, opened from a state of idle in feedback mode control. When the engine is accelerated with the throttle valve 5 fully opened from a state of idle with the throttle valve 5 fully closed in feedback mode control as shown in (a) in FIG. 6, the control of supply of intake air can then be effected in response to the opening of the throttle valve 5, and accordingly the supply of supplementary air may become unnecessary. However, if the supply of supplementary air is interrupted at the same time as the throttle valve 5 is opened, the engine rpm decreases due to an abrupt decrease in the supply of supplementary air, causing difficulty in smooth engagement of the clutch and without causing engine stall. In order to prevent this, the valve opening period DOUT of the control valve 6 immediately after the opening of the throttle valve 5 is maintained at a value $DPI_{n-1}$ determined in the last feedback mode control loop executed immediately before the opening of the throttle valve 5. After that, this valve opening period DOUT is gradually reduced by a fixed amount at each of the TDC pulses (hereinafter called "acceleration mode control"). Once this gradually decreased valve opening period DOUT reaches a very short period Do (ineffective period) at which the control valve 6 does not open substantially due to the decrease in the period of energization of the solenoid 6*a* of the control valve 6, the valve opening period DOUT is set to 0, because after that, energization of the control valve 6 results in a waste of electric power as well as in reduced durability of the control valve 6. This is called "stop mode".

If electrical load is applied on the engine, during the above acceleration mode control of the engine 1, this electrical load increases the engine load and accordingly the engine rpm Ne abruptly decreases (the broken line in (a) in FIG. 6), causing discomfort to the driver and badly affecting the driveability of the engine, as in the feedback mode control and in the deceleration mode control previously explained with reference to FIG. 2 and FIG. 4, respectively. Even during the acceleration mode control, in the same manner as explained with reference to FIG. 2, it is possible to estimate the necessary quantity of supplementary air supplied to the engine corresponding to each kind of electrical device that produces the electrical load. Therefore, also during this acceleration mode control, the on-off state signal of each electrical device indicative of the occurrence of electrical load is monitored, and simultaneously with the output of on-state signal the valve opening period DOUT of the control valve 6 is increased just by the electrical load term DE as shown in (c) in FIG. 6. That is, the valve opening period DOUT is determined by the following equation:

$$DOUT = DPI_{n-1} - mDA + DE \quad (3)$$

where $DPI_{n-1}$ is a control valve opening period determined in the last control loop in feedback mode control immediately before the opening of the throttle valve, DA is a constant determined experimentally, and m indicates the number of pulses of the TDC signal counted from the time the throttle valve 5 is opened. The electrical load term DE is determined in the same manner as previously explained with reference to FIG. 3.

An increased quantity of supplementary air, as calculated by the above equation (3), is supplied to the engine simultaneously with the occurrence of electrical load on the engine, not only preventing any abrupt drop in the engine rpm but also improving the driveability of the engine. When the valve opening period DOUT from the equation (3) decreases below the ineffective-valve opening time Do, the period DOUT is then considered equal to zero, interrupting the energization of the control valve 6 to close same, as shown in (c) in FIG. 6.

Figure 7:
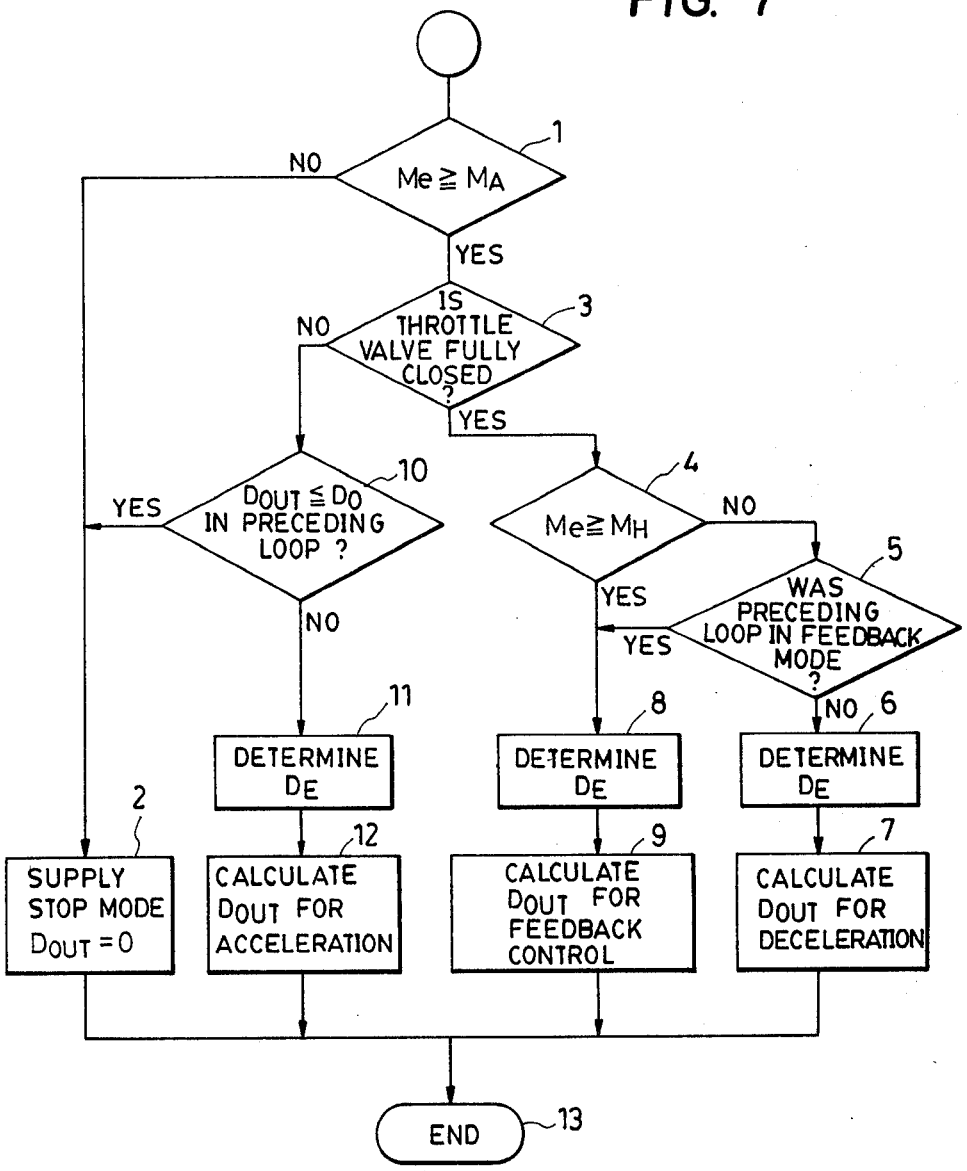
FIG. 7 is a flow chart showing a routine for practicing the method of the invention, which is executed inside the ECU in FIG. 1.

FIG. 7 shows a flow chart of a program routine for carrying out the control of the increase in the supplementary air being supplied to the engine at the time electrical load is applied on the engine, already explained with reference to FIG. 2 through FIG. 6, which is executed within the ECU 9 in FIG. 1.

If this program is called within the ECU 9, it is determined at the step 1 whether or not the value Me, which is proportionate to the reciprocal of the engine rpm Ne, is larger than a value MA which is proportionate to the reciprocal of the predetermined value NA, shown in (a) in FIG. 4. At the step 1, if the answer is no (i.e. Me≧MA is not satisfied), that is, if the engine rpm Ne is larger than the predetermined value NA, the valve opening period DOUT is set to zero at the step 2, as the supply of supplementary air to the engine is then unnecessary, and the program is terminated at the step 13. If, on the other hand, the answer at the step 1 is yes (Me≧MA is satisfied), that is, if the engine rpm Ne is smaller than the predetermined value NA, whether or not the throttle valve 5 is then fully closed is determined in the step 3. If the throttle valve 5 is fully closed, whether or not the value Me is larger than the value MH is determined at the step 4. If the answer to the step 4 is no, that is, if the engine rpm Ne is larger than the predetermined upper limit NH of the desired idling rpm range, as hereinafter explained in detail, in step 5 it is determined at the step 5 whether or not the last loop was in feedback mode. If the answer is negative, then the program previously explained with reference to FIG. 3 is called, and the electrical load term DE of the valve opening period DOUT of the control valve 6 is calculated in dependence on the on-off states of the electrical devices 15, 18 and 20, in the step 6. Then, using the deceleration mode term DX available in FIG. 5 and the electrical load term DE calculated in the step 6, the valve opening period DOUT in the deceleration mode is obtained from the equation (2) at the step 7, and the program is then terminated.

When the engine rpm Ne decreases so that the answer to the question of the step 4 becomes yes (Me≧MH is satisfied), that is, the engine rpm Ne becomes lower than the predetermined upper limit NH of the desired idling rpm range thereby moving into feedback mode control region, shown in (c) in FIG. 4, the electrical load term DE shown in FIG. 3 is calculated at the step 8. Then at the step 9, the valve opening period DOUT in feedback mode control is calculated on the basis of the equation (1), and the program is terminated.

During the idle rpm feedback mode control, it can sometimes so happen that the engine rpm Ne can exceed the upper limit NH of the desired idling rpm range either due to external disturbances or due to reduction in the engine load caused by extinction of electrical load on the engine. In such event, once the deceleration mode control is terminated and the feedback mode control is started, the supplementary air quantity is continued in feedback mode even if the engine rpm Ne exceeds the upper limit NH of the desired idling rpm range, so long as the throttle valve 5 is fully closed. Because, on such occasion, there is no possibility of engine stall, and swift and accurate rpm control is possible rather by feedback mode control. In this way, when the engine rpm Ne exceeds the upper limit NH of the desired idling rpm range, due to external disturbance or due to extinction of the electrical load on the engine, it is determined at the step 4 that the relationship of Me≧MH is no longer valid, and the program will proceed to the step 5. At the step 5, it is determined whether or not the last control loop was executed in feedback mode, and if it was (that is, the answer is yes) then the program proceeds to the step 8 and the step 9, continuing the execution of feedback mode control.

During feedback mode control of the idling engine, shown in FIG. 6, when the throttle valve 5 is opened to cause transition into acceleration mode control, the answer to the question of the step 3 becomes no, and therefore the program proceeds to the step 10 to determine whether or not the valve opening period DOUT of the control valve 6 in the preceding loop was smaller than the predetermined value $D_o$, shown in (c) in FIG. 6. When the answer is no, in the step 11, in accordance with the program shown in FIG. 3, the electrical load term DE of the valve opening period DOUT is calculated, and the new valve opening period in acceleration mode is calculated using the equation (3) in the step 12. The program is then terminated.

When the valve opening period DOUT in acceleration mode is gradually decreased to make the relationship of DOUT≦$D_O$ stands in the step 10, the valve opening period DOUT is set to zero in the step 2, and the program is then terminated.

Figure 8:
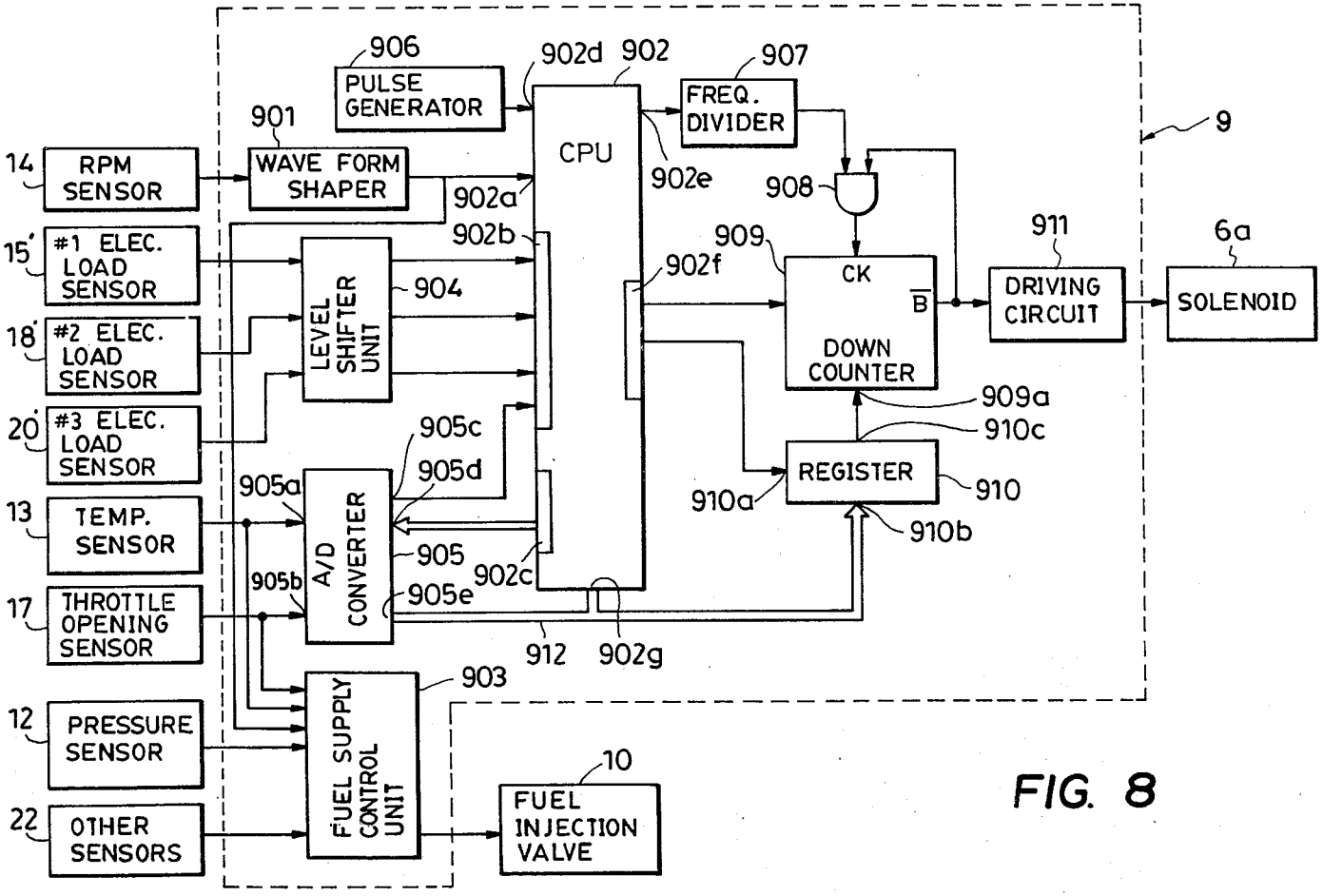
FIG. 8 is a circuit diagram showing an electrical circuit inside the ECU in FIG. 1.

Next, the electrical circuit in the ECU 9 will now be described by referring to FIG. 8 which illustrates an embodiment thereof.

The engine rpm sensor 14 in FIG. 1 is connected to an input terminal 902*a* of a one chip CPU (hereinafter merely called "CPU") 902 by way of a waveform shaper 901 which has its output also connected to the input of a fuel supply control unit 903, all provided in the ECU 9. Reference numerals 15', 18' and 20' represent sensor means for detecting the electrical loads of the electrical devices 15, 18 and 20 in FIG. 1 which are connected to respective ones of a group of further input terminals 902*b* of the CPU 902 by way of a level shifter 904 in the ECU 9. The water temperature sensor 13 and the throttle valve opening sensor 17 are connected, respectively, to input terminals 905*a* and 905*b* of an analog-to-digital converter 905 and are also both connected to the input of the fuel supply control unit 903. The analog-to-digital converter 905 has an output terminal 905*c* connected to the input terminals 902*b* of the CPU 902 and a group of further input terminals 905*d* connected to a group of output terminals 902*c* of the CPU 902. A pulse generator 906 is connected to another input terminal 902*d* of the CPU 902 which in turn has an output terminal 902*e* connected to an AND circuit 908 at its one input terminal, by way of a frequency divider 907. The AND circuit 908 has its output connected to a clock pulse input terminal CK of a down counter 909. The AND circuit 908 has its other input terminal connected to a borrow output terminal $\overline{B}$ of the down counter 909 which terminal is further connected to the solenoid 6*a* of the control valve 6 in FIG. 1, by way of a solenoid driving circuit 911. The CPU 902 has another group of output terminals 902*f*, one of which is connected to a load input terminal L of the down counter 909 and another to an input terminal 910*a* of a register 910, respectively. The output terminal 910*c* of the register 910 is connected to the input terminal 909*a* of the down counter 909. The analog-to-digital converter 905, the CPU 902, and the register 910 are connected together by way of a data bus 912, respectively, at an output terminal 905*e*, an input and output terminal 902*g* and an input terminal 910*b*.

Connected to the fuel supply control unit 903 are the intake air pressure or absolute pressure sensor 12 and the other engine parameter sensors 22 such as an atmospheric pressure sensor, all appearing in FIG. 1. The output of the fuel supply control unit 903 is connected to the fuel injection valve 10 in FIG. 1.

The electrical circuit of the ECU 9 constructed above operates as follows: An output signal from the engine rpm sensor 14 is supplied to the ECU 9 as a signal indicative of engine rpm Ne as well as a signal indicative of a predetermined crank angle of the engine 1 (TDC), where it is subjected to waveform shaping by the waveform shaper 901 and then supplied to the CPU 902 and the fuel supply control unit 903. As explained before, the routine in FIG. 7 is executed in synchronization with the TDC signal. Upon being supplied with this top dead center signal, the CPU 902 generates a chip selecting signal, a channel selecting signal, an analog-to-digital conversion starting signal, etc. commanding the analog-to-digital converter 905 to convert analog signals such as the engine cooling water temperature signal and the throttle valve opening signal from the cooling water temperature sensor 13 and the throttle valve opening sensor 17 into corresponding digital signals. The digital signals indicative of the cooling water temperature and the throttle valve opening from the converter 905 are supplied as data signals to the CPU 902 via the data bus 912 when a signal indicative of termination of each analog-to-digital conversion is supplied to the CPU 902 from the output terminal 905*c* of the analog to digital converter 905. Upon completion of conversion of one of these digital signals to the CPU 902, the same process as above is once again effected to cause inputting of the other digital signal to the CPU 902. Further, electrical load-indicative signals from the electrical load sensor means 15', 18' and 20' have their voltage levels shifted to a predetermined level by the level shifter 904 and then applied to the CPU 902.

The CPU 902 operates on these input data signals, i.e. the engine rpm signal, the electrical load signal, the engine water temperature signal and the throttle valve opening signal, in line with the steps of control explained with reference to FIG. 7, to determine whether the control of the supplementary air quantity should be effected in stop mode, feedback mode, decelerating mode, or acceleration mode. That is, for example, the CPU judges that decelerating mode control should be effected, when the engine rpm Ne becomes lower than the predetermined value NA, and higher than the upper limit NH of the desired idling rpm range with the throttle valve fully closed, if the preceding control loop was not in feedback mode. The CPU 902 calculates the electrical load term DE of the valve opening period DOUT, in accordance with the program in FIG. 3, in dependence on electrical load signals from the electrical load sensor means 15', 18' and 20', and further the CPU 902 determines the valve opening period DOUT of the control valve 6 on the basis of the equation (2) corresponding to decelerating mode. Then, the CPU 902 supplies the register 910 with calculated value of the valve opening period DOUT via the data cable 912, upon inputting of a command signal to the register 910 through its load input terminal L.

On the other hand, a clock signal generated by the pulse generator 906 is used as a timing signal for the control operation carried out by the CPU 902, and at the same time it is subjected to frequency division by the frequency divider 907 into a suitable frequency and then supplied to one input terminal of the AND circuit 908.

Then, the CPU 902 supplies a starting command signal to the down counter 909 through its load input termianl L at a predetermined moment, to open the control valve 6.

When the down counter 909 is supplied with the starting command signal from the CPU 902, it is loaded with a calculated value indicative of the desired valve opening period DOUT of the control valve 6 for deceleration mode control stored in the register 910. At the same time, the down counter 909 generates a high level output of 1 at its borrow output terminal $\overline{B}$ and applies it to the other input terminal of the AND circuit 908 as well as the solenoid driving circuit 911. The solenoid driving circuit 911 energizes the solenoid 6*a* of the control valve 6 to open same as long as it is supplied with the above high level output of 1 from the down counter 909, that is, the control valve 6 is opened with a duty ratio corresponding to the valve opening period DOUT.

As long as the AND circuit 908 has its other input terminal supplied with the above high level output of 1 from the down counter 909, it allows clock pulses supplied thereto through its one terminal to be applied to the clock pulse input terminal CK of the down counter 909. The down counter 909 counts the clock pulses, and upon counting up to a number corresponding to the calculated value of the valve opening period DOUT supplied thereto from the register 910, it generates a low level output of 0 through its borrow output terminal $\overline{B}$ to cause the solenoid driving circuit 911 to deenergize the solenoid 6*a* of the control valve 6. At the same time, the above low level output of the down counter 909 is supplied to the AND circuit 908 as well, to interrupt the supply of further clock pulses to the down counter 909. Since similar explanations to the above apply as well even when the CPU 902 judges that feedback mode control or acceleration mode control is to be effected, further explanations are omitted. Further, when the CPU determines that stop mode control should be effected, no starting command signal is transmitted from the CPU 902 to the down counter 909 and accordingly the down counter 909 and the solenoid driving circuit 911 remain inoperative, thereby maintaining the control valve 6 fully closed.

On the other hand, the fuel supply control unit 903 operates on engine operation parameter signals supplied from the engine rpm sensor 14, the engine water temperature sensor 13, the throttle valve opening sensor 17, the absolute pressure sensor 12 and the other engine operation parameter sensors 22, to calculate a desired value of fuel supply quantity so as to keep the air/fuel ratio of the mixture being supplied to the engine 1 at an optimum value, e.g. a theoretical air/fuel ratio, and to open the fuel injection valve 10 for a period of time corresponding to the calculated value.

What is claimed is:

1. In a method for controlling the idling rpm of an internal combustion engine having an intake passage, a throttle valve arranged in said intake passage, an air passage having one end communicating with said intake passage at a location downstream of said throttle valve and another end communicating with the atmosphere, respectively, and a plurality of electrical devices disposed to apply respective loads on said engine, said supplementary air being supplied to said engine through said air passage and said intake passage wherein the quantity of said supplementary air is controlled in a predetermined manner selected in response to operating conditions of said engine, the improvement comprising the steps of:

setting a plurality of different predetermined quantities of supplementary air to be supplied to said engine, which individually correspond to the magnitudes of electrical loads applied by respective ones of said electrical devices;

detecting the on-off state of each of said electrical devices;

determining whether or not said engine is in a predetermined operating condition wherein said throttle valve is fully closed and the engine rpm is lower than a first predetermined value corresponding to an upper limit of desired idling rpm;

controlling the quantity of supplementary air in a feedback mode manner, as said predetermined manner, responsive to the difference between actual engine rpm and said desired idling rpm, when said engine is determined to be in said predetermined operating condition; and simultaneously with detection of the on-state of at least one of said electrical devices during said feedback mode controlling step, increasing the quantity of supplementary air by at least one of said different predetermined quantities corresponding to the magnitude of at least one electrical load applied by said at least one electrical device.

2. In a method for controlling the idling rpm of an internal combustion engine having an intake passage, a throttle valve arranged in said intake passage, an air passage having one end communicating with said intake passage at a location downstream of said throttle valve and another end communicating with the atmosphere, respectively, an electromagnetic control valve arranged across said air passage, and a plurality of electrical devices disposed to apply respective loads on said engine, said supplementary air being supplied to said engine through said air passage and said intake passage wherein the quantity of said supplementary air is controlled by varying the valve opening period of said electromagnetic control valve in a predetermined manner selected in response to operating conditions of said engine, the improvement comprising the steps of:

(a) setting a plurality of different predetermined quantities of supplementary air to be supplied to said engine, which individually correspond to the magnitudes of electrical loads applied by respective ones of said electrical devices;

(b) detecting the on-off state of each of said electrical devices;

(c) determining whether or not said engine is in a predetermined operating condition wherein said throttle valve is fully closed and the engine rpm is lower than a first predetermined value corresponding to an upper limit of desired idling rpm;

(d) when said engine is determined to be in said predetermined operating condition, controlling the quantity of supplementary air in a feedback mode manner, as said predetermined manner, responsive to the difference between actual engine rpm and said desired idling rpm; and (e) simultaneously with detection of the on-state of at least one of said electrical devices during said feedback mode control, increasing the quantity of supplementary air by at least one of said different predetermined quantities corresponding to the magnitude of at least one electrical load applied by said at least one electrical device that is in the on-state by increasing the valve opening period of said electromagnetic control valve.

3. In a method for controlling the idling rpm of an internal combustion engine having an intake passage, a throttle valve arranged in said intake passage, an air passage having one end communicating with said intake passage at a location downstream of said throttle valve and another end communicating with the atmosphere, respectively, an electromagnetic control valve arranged across said air passage, and a plurality of electrical devices disposed to apply respective loads on said engine, said supplementary air being supplied to said engine through said air passage and said intake passage wherein the quantity of said supplementary air is controlled by varying the valve opening period of said electromagnetic control valve in a predetermined manner selected in response to operating conditions of said engine, the improvement comprising the steps of:

(a) setting a plurality of different predetermined quantities of supplementary air to be supplied to said engine, which individually correspond to the magnitudes of electrical loads applied by respective ones of said electrical devices;

(b) detecting the on-off state of each of said electrical devices;

(c) determining whether or not said engine is in a predetermined operating condition wherein it is decelerating with said throttle valve fully closed;

(d) when said engine is determined to be in said predetermined operating condition, controlling the quantity of supplementary air in said predetermined manner such that the quantity of supplementary air is gradually increased from the time the engine rpm drops below a second predetermined value which is larger than a first predetermined value corresponding to an upper limit of desired idling rpm, and said quantity of supplementary air is set to a predetermined value when the engine rpm reaches said first predetermined value; and (e) simultaneously with detection of the on-state of at least one of said electrical devices during said control of the supplementary air quantity at engine deceleration, increasing the quantity of supplementary air by at least one of said different predetermined quantities corresponding to the magnitude of at least one electrical load applied by said at least one electrical device that is in the on-state by increasing the valve opening period of said electromagnetic control valve.

4. In a method for controlling the idling rpm of an internal combustion engine having an intake passage, a throttle valve arranged in said intake passage, an air passage having one end communicating with said intake passage at a location downstream of said throttle valve and another end communicating with the atmosphere, respectively, an electromagnetic control valve arranged across said air passage, and a plurality of electrical devices disposed to apply respective loads on said engine, said supplementary air being supplied to said engine through said air passage and said intake passage wherein the quantity of said supplementary air is controlled by varying the valve opening period of said electromagnetic control valve in a predetermined manner selected in response to operating conditions of said engine, the improvement comprising the steps of:

(a) setting a plurality of different predetermined quantities of supplementary air to be supplied to said engine, which individually correspond to the magnitudes of electrical loads applied by respective ones of said electrical devices;

(b) detecting the on-off state of each of said electrical devices; and (c) simultaneously with the detection of the on-state of each of said electrical devices, increasing the quantity of supplementary air by the sum of at least two of said different predetermined quantities at the same time, when it is detected that at least two of said electrical devices are in the on-state at the same time, to which said at least two different predetermined quantities correspond, by increasing the valve opening period of said electromagnetic control valve.

5. A method as claimed in claim 1, including the steps of: determining whether or not said engine is in a predetermined operating condition wherein it is decelerating with said throttle valve fully closed; when said engine is determined to be in said predetermined operating condition, controlling the quantity of supplementary air in said predetermined manner such that the quantity of supplementary air is gradually increased from the time the engine rpm drops below a second predetermined value which is larger than a first predetermined value being an upper limit of desired idling rpm, and it is set to a predetermined value when the engine rpm reaches said first predetermined value; and simultaneously with detection of the on-state of at least one of said electrical devices during said control of the supplementary air quantity at engine deceleration, increasing the quantity of supplementary air by at least one of said different predetermined quantities corresponding to the magnitude of at least one electrical load applied by said at least one electrical device.

6. A method as claimed in claim 1, including the steps of: determining whether or not said engine is in a second predetermined operating condition wherein during said feedback mode control said throttle valve is opened to accelerate said engine; when said engine is determined to be in said second predetermined operating condition, controlling the quantity of supplementary air in said predetermined manner such that immediately after the opening of said throttle valve it is set to a value equal to the last value determined in said feedback mode control and thereafter is gradually decreased; and simultaneously with detection of the on-state of at least one of said electrical devices during said control of the quantity of supplementary air at engine acceleration, increasing the quantity of supplementary air by at least one of said different predetermined quantities corresponding to the magnitude of at least one electrical load applied by said at least one electrical device.

7. A method as claimed in claim 1, including the step of increasing the quantity of supplementary air by the sum of at least two of said different predetermined quantities at the same time, when it is detected that at least two of said electrical devices are in on-state at the same time, to which said at least two different predetermined quantities correspond.

8. A method as claimed in claim 2, including the steps of: determining whether or not said engine is in a second predetermined operating condition wherein during said feedback mode controlling step said throttle valve is opened to accelerate said engine; when said engine is determined to be in said second predetermined operating condition, controlling the quantity of supplementary air in said predetermined manner such that immediately after the opening of said throttle valve said quantity of supplementary air is set to a value equal to the last value determined in said feedback mode controlling step and thereafter is gradually decreased; and simultaneously with detection of the on-state of at least one of said electrical devices during said control of the quantity of supplementary air at engine acceleration, increasing the quantity of supplementary air by at least one of said different predetermined quantities corresponding to the magnitude of at least one electrical load applied by said at least one electrical device.

* * * * *